US005752138A

United States Patent [19]

Wing et al.

[11] Patent Number: 5,752,138

[45] Date of Patent: May 12, 1998

[54] VACUUM ASSISTED BEAD PICK OFF APPARATUS HAVING A SPIRAL PLURAL LEVEL SURFACE

[75] Inventors: Joseph M. Wing, Ontario; Mark E. Roszkowski, Fairport; Kerry P. Haughan, Pittsford; James F. Lincoln, Hilton; Robert A. Pictor, Webster, all of N.Y.

[73] Assignee: Xerox Corporation, Stamford, Conn.

[21] Appl. No.: 567,378

[22] Filed: Dec. 4, 1995

[51] Int. Cl.[6] ..... G03G 15/095

[52] U.S. Cl. ..... 399/264

[58] Field of Search ..... 355/297, 305, 355/296, 306, 253, 215; 118/657, 658; 399/264, 249, 343, 98, 99

[56] References Cited

U.S. PATENT DOCUMENTS

| | | | |
|---|---|---|---|
| 4,292,924 | 10/1981 | Lindblad et al. | 399/277 |
| 4,466,730 | 8/1984 | Jugle | 399/103 |
| 5,225,880 | 7/1993 | Shehata et al. | 399/264 |
| 5,280,323 | 1/1994 | Alvarez et al. | 399/264 |
| 5,283,617 | 2/1994 | Benedict et al. | 399/264 |
| 5,379,094 | 1/1995 | Wing et al. | 399/264 |
| 5,404,215 | 4/1995 | Bares | 399/264 |

*Primary Examiner*—S. Lee
*Attorney, Agent, or Firm*—John S. Wagley

[57] ABSTRACT

An apparatus for removing magnetic granules from a moving imaging surface in a region between a developer station and a transfer station is provided. The apparatus includes a removing member located between the developer station and the transfer station. The removing member is rotatable about a longitudinal axis. A groove is located in an exterior surface of the removing member. A portion of the groove extends in a direction skewed to the longitudinal axis of the removing member. The apparatus also includes a a magnetic member which is operatively associated with the removing member. The magnetic member generates a magnetic field to attract the magnetic granules from the imaging surface to the removing member. The removing member and the magnetic member move relatively to one another.

32 Claims, 7 Drawing Sheets

VACUUM ASSISTED BEAD PICK OFF APPARATUS HAVING A SPIRAL PLURAL LEVEL SURFACE

This invention relates generally to a bead pick off device of a development system for an electrophotographic printing machine adapted to produce highlight color and monochromatic copies, and more particularly concerns a bead pick off apparatus for removing ferromagnetic carrier beads and non ferromagnetic particles from a photoconductive surface delivered by a developer unit prior to transfer to a copy sheet.

The relevant parts of U.S. Pat. No. 4,829,338, U.S. Pat. No. 4,811,046 and U.S. Pat. No. 5,379,094 are incorporated herein by reference.

The features of the present invention are useful in the printing arts and more particularly in electrophotographic printing. In the process of electrophotographic printing, a photoconductive surface is charged to a substantially uniform potential. The photoconductive surface is image wise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image in a region known as the development zone. Toner particles are attracted from beads of the developer material onto the latent image. The resultant toner powder image is then transferred from the photoconductive surface to a copy sheet and permanently affixed thereto. The foregoing generally describes a typical mono-color electrophotographic copying machine.

Recently, electrophotographic printing machines have been developed which produce highlight color copies. A typical highlight color printing machine records successive electrostatic latent images on the photoconductive surface. When combined, these electrostatic latent images form a total latent image corresponding to the entire original document being reproduced. Thus, one latent image is usually developed with black toner particles. The other latent image is developed with color highlighting toner particles, e.g. red toner particles. These developed toner images are transferred in registration to the copy sheet to form the color highlighted copy.

In tri-level electrophotographic printing, the charge on the photoconductive surface is divided in three, rather than two, ways as is the case in mono-color printing. The photoconductive surface is charged, typically to about 900 volts. It is exposed image wise, such that one image corresponding to charged image areas remains at the full potential of 900 volts. The other image, which corresponds to discharged image areas is exposed to discharge the photoconductive surface to its residual potential of typically about 100 volts. The background areas are exposed to reduce the photoconductive surface potential to about halfway between the charged and discharged potentials, (typically about 500 volts). The developer unit arranged to develop the charged image areas, is typically biased to about 600 volts, and the developer unit, arranged to develop the discharged image areas, is biased to about 400 volts.

The single pass nature of this system dictates that the electrostatic latent image pass through the developer units in a serial fashion. The electrostatic forces and adhesion forces within the developer units and between the photoconductive surface contribute to a condition where the beads are carried out of the development unit. Bead removal devices (BRDs) are well known and commonly used to pick off any beads which are carried out of the development zone of a development unit.

Generally BRDs operate by generating a strong magnetic field in the area between the photoconductive surface and the BRD to attract free beads to the shell of the BRD. The beads are typically made from ferro-magnetic material, while the toner in the developed image is made from a non-ferro-magnetic material. The BRD can generally remove the magnetic beads, while not disturbing the latent toner image on the photoreceptor belt. These captured beads are then deposited in a sump or developer receiver as the shell of the BRD is rotated. This arrangement, however, renders release of beads from the BRD more difficult, e.g. gravity and centripetal forces often are insufficient to achieve release of the beads from the magnetic field as the shell of the BRD rotates. That is the strong magnetic field necessary to attract beads from the photoconductive surface to the BRD shell are sufficiently strong around the shell itself to retain some beads as the shell rotates.

As disclosed in U.S. Pat. No. 4,829,338, the magnetic field from the magnet positioned in the shell of the BRD can be directed by use of a ferromagnetic shunt to promote bead removal from the photoconductive surface while enhancing the field between the photoconductive surface and the BRD to attract free beads.

For example, a condition associated with BRD rollers is that during ordinary operation of the BRD rollers some beads fail to move with the circumference of the BRD rollers and tend to ride or "walk" over the shell of the roller such that these beads remain in a substantially constant position as the roller rotates under them. Generally, the attraction of gravity and the magnetic force are sufficient to hold most beads to the roller for movement to the release zone. However, in many cases, particularly on longer print jobs, not all beads are transported to the release area. In this case, bead groups form along the surface of the BRD roller and do not move to the release area.

It is believed that this "walking" phenomena is due to the magnetic fields generated along the surface of the roller which are greatest in the pick off zones of the BRD roller and lessen around the circumference. Thus, as the roller rotates, beads attracted to the BRD at the pick off zone are magnetically urged back toward the pick off zone so that they remain in a relatively constant position. In fact, over time this can involve a substantial number of beads.

The relatively stationary beads tend to conglomerate and disturb toner riding on the surface of the BRD to form a toner cloud. Some of the toner in the cloud has been found to settle on the moving photoconductive surface. This settled toner can cause a print defect, referenced hereinafter as a "smudge", which appears as a background colorant in a localized area of a printed copy sheet. Generally, smudges tend to vary in size but are generally 3–4 mm long by 2 mm wide. In any event, a smudge is a defect which impacts particularly upon high quality graphic printing. Thus, controlling smudging of images is critical to the utility of printing machines in many applications. Thus, the beads build up along the surface of the BRD roller and the smudging of the printed copy sheets in many cases are related.

As disclosed in U.S. Pat. No. 5,379,094, axial grooves have been added to the periphery of the sleeve of the BRD to alleviate the bead walking problem. Nevertheless, this solution has not overcome all problems associated with BRDs.

In order for the magnet in the BRD to provide a magnetic field to the beads of sufficient strength, the sleeve needs to have a thin cross section or thickness of approximately 0.4 to 1.0 mm. The sleeve with the thin cross section is structurally weak. The thin cross section precludes the use of an extrusion process in fabricating the axial grooves into the sleeve. The axial grooves must be etched or machined from a cylindrical sleeve. The removal of the material from the sleeve to form the grooves causes the hoop stresses in the sleeve to be relieved. The relief of the hoop stresses causes the sleeve to distort into an out of round condition. To alleviate this out of round condition a plurality of axial grooves are equally positioned in the periphery of the sleeve. For example thirty or more grooves may be located in the periphery of a sleeve having a diameter of 30 mm. The addition of these grooves further weakens the strength of the sleeve. Further the machining of all these grooves adds significantly to the cost of the sleeve.

Often the beads accumulate in a certain position along the width of the photoreceptor. These beads rapidly fill the grooves in that axial position of the sleeve adjacent the portion of the photoreceptor where the beads have accumulated. The effectiveness of the BRD is thus adversely affected.

Various techniques have heretobefore been used to develop electrostatic latent images as illustrated by the following disclosures, which may be relevant to certain aspects of the present invention:

U.S. Pat. No. 4,292,924

Patentee: Lindblad et al.

Issued: Oct. 6, 1981

U.S. Pat. No. 4,466,730

Patentee: Jugle, et al.

Issued: Aug. 21, 1984

U.S. Pat. No. 5,225,880

Patentee: Shehata et al.

Issued: Jul. 6, 1993

U.S. Pat. No. 5,283,617

Patentee: Benedict et al.

Issued: Feb. 1, 1994

U.S. Pat. No. 5,280,323

Patentee: Alvarez et al.

Issued: Jan. 18, 1994

U.S. Pat. No. 5,379,094

Patentee: Wing et al.

Issued: Jan. 3, 1995

The relevant portions of the foregoing patents may be briefly summarized as follows:

U.S. Pat. No. 4,292,924 discloses a magnetic brush apparatus for cleaning photoconductive surfaces and suggests its application to magnetic brush development mechanisms. The disclosure device has a series of magnetics disposed within a rotating cylindrical sleeve disposed within a cleaning housing. The cleaning housing has an aperture which is proximate a photoconductive surface so that the surface is cleaned as it passes the aperture. The sleeve is provided with field shaping devices at the extreme ends of the cleaning roller so that developer material attracted to the sleeve does not build at the extreme ends of the cylindrical sleeve.

U.S. Pat. No. 4,466,730 discloses a magnetic brush developer unit having a housing in which a magnet is disposed within a rotating tubular member for transporting beads with toner adhering thereto to a photoconductive surface. The area adjacent the tubular member and within the housing has a negative air pressure as air is withdrawn from the housing so that airborne toner and toner on the metering blade are attracted to the bottom of the housing.

U.S. Pat. No. 5,225,880 also discloses a system for removing agglomerates from a developed image on a photoreceptor in an electrophotographic printing machine. The disclosed apparatus uses a vacuum source to draw the agglomerates from the developed image.

U.S. Pat. No. 5,283,617 discloses a development system which includes a similar apparatus of that disclosed by U.S. Pat. No. 5,280,323, which further includes a vacuum source to generate an overflow to attract beads from the photoconductive surface and to the BRD. The airflow also aides in the cleaning of the BRD roller.

U.S. Pat. No. 5,280,323 discloses a development system which includes an apparatus for removing beads from a photoconductive surface. The disclosed apparatus includes magnets which attract the beads to a bead removal roller and magnetic shunts to shape the generated fields.

U.S. Pat. No. 5,379,094 discloses a development system which includes a similar apparatus of that disclosed by U.S. Pat. No. 5,283,617, which further includes a plural level BRD eccentrically mounted in a housing for connection to a vacuum source to generate an overflow to attract beads from the photoconductive surface and to the BRD. The airflow also aides in the cleaning of the BRD roller.

In accordance with one aspect of the present invention, there is provided an apparatus for removing magnetic granules from a moving imaging surface in a region between a developer station and a transfer station. The apparatus includes a removing member located between the developer station and the transfer station. The removing member is rotatable about a longitudinal axis. A groove is located in an exterior surface of the removing member. A portion of the groove extends in a direction skewed to the longitudinal axis of the removing member. The apparatus also includes a magnetic member which is operatively associated with the removing member. The magnetic member generates a magnetic field to attract the magnetic granules from the imaging surface to the removing member. The removing member and the magnetic member move relatively to one another.

In accordance with another aspect of the present invention, there is provided a developer unit for developing a latent image recorded on an image receiving member to form a developed image for later transfer to a surface at a transfer station. The developer unit includes a housing having a chamber for storing a supply of magnetic granules and marking particles within the chamber. The developer unit also includes a moving donor member spaced from the image receiving member. The donor member transports marking particles from the chamber of the housing to a development zone adjacent the image receiving member. The developer unit further includes an apparatus for removing the magnetic granules from the image receiving member in a region between the donor member and a transfer station. The apparatus includes a removing member located between the developer station and the transfer station. The removing member is rotatable about a longitudinal axis. A groove is located in an exterior surface of the removing member. A portion of the groove extends in a direction skewed to the longitudinal axis of the removing member. The apparatus also includes a a magnetic member which is operatively associated with the removing member. The magnetic member generates a magnetic field to attract the magnetic granules from the imaging surface to the removing member. The removing member and the magnetic member move relatively to one another.

In accordance with yet another aspect of the present invention, there is provided an electrophotographic printing machine of the type having a developer unit adapted to develop with marking particles a latent image recorded on an image receiving member for later transfer to a surface at a transfer station. The developer unit includes a housing having a chamber for storing a supply of magnetic granules and marking particles within the chamber. The developer unit also includes a moving donor member spaced from the image receiving member. The donor member transports marking particles from the chamber of the housing to a development zone adjacent the image receiving member. The developer unit further includes an apparatus for removing the magnetic granules from the image receiving member in a region between the donor member and a transfer station. The apparatus includes a removing member located between the developer station and the transfer station. The removing member is rotatable about a longitudinal axis. A groove is located in an exterior surface of the removing member. A portion of the groove extends in a direction skewed to the longitudinal axis of the removing member. The apparatus also includes a a magnetic member which is operatively associated with the removing member. The magnetic member generates a magnetic field to attract the magnetic granules from the imaging surface to the removing member. The removing member and the magnetic member move relatively to one another.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 2:
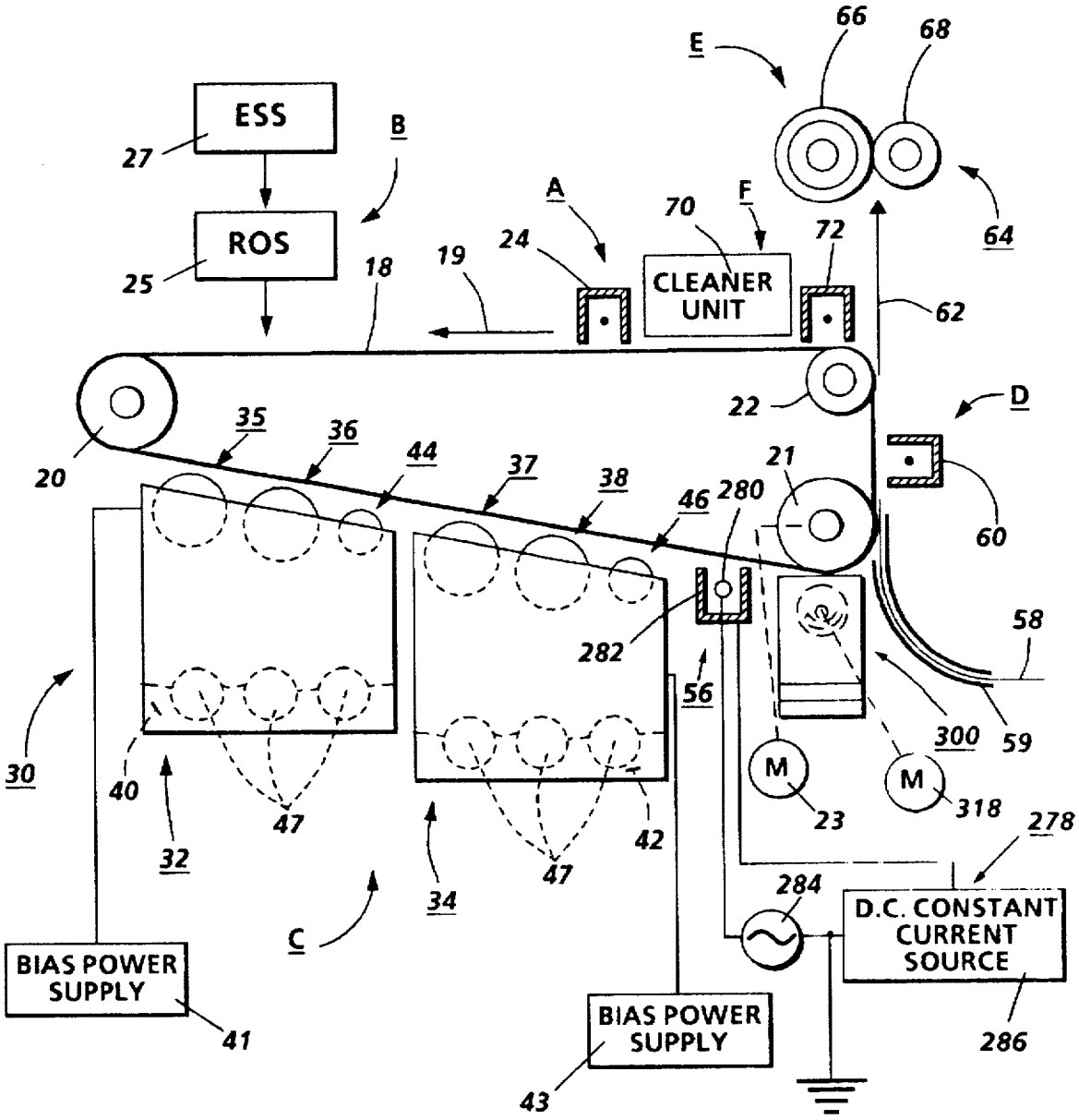
FIG. 2 is a schematic elevational view of an illustrative electrophotographic printing machine incorporating the developer units and bead removal device of the present invention therein.

For a general understanding of the illustrative electrophotographic printing machine incorporating the features of the present invention therein, reference is made to the drawings. In the drawings, like reference numerals have been used throughout to designate identical elements. FIG. 2 schematically depicts the various components of an electrophotographic printing machine incorporating the developer units of the present invention therein. Although the developer units of the present invention are particularly well adapted for use in the illustrative printing machine, it will become evident that these developer units are equally well suited for use in a wide variety of printing machines and are not necessarily limited in their application to the particular embodiments shown herein.

Referring now to FIG. 2, the electrophotographic printing machine employs a belt 18, i.e., a charge retentive member, having a photoconductive surface deposited on a conductive substrate. Belt 18 moves in the direction of arrow 19 to advance successive portions thereof sequentially through the various processing stations disposed about the path of movement thereof. Belt 18 is entrained about drive roller 21, tensioning roller 20 and stripping roller 22. Motor 23 rotates roller 21 to advance belt 18 in the direction of arrow 19. Roller 21 is coupled to motor 23 by suitable means such as a belt drive.

Initially successive portions of belt 18 pass through charging station A. At charging station A, a corona generating device, indicated generally by the reference numeral 24, charges the belt 18 to a selectively high uniform electrical potential, preferably negative. Any suitable control, well known in the art, may be employed for controlling the corona generating device 24.

Next, the charged portions of the photoconductive surface are advanced through exposure station B. At exposure station B, the uniformly charged photoconductive surface or charge retentive surface is exposed to a laser based raster output scanning device 25 which causes the charge retentive surface to be selectively discharged in accordance with the output from the scanning device 25. Preferably, the scanning device is a three level laser Raster Output Scanner (ROS). The output scanning device 25 is driven by an input signal from an electronic subsystem (ESS) 27, which would serve as the interface between the device 25 and an input signal generator (not shown). Thus, in this embodiment, the photoconductive surface, which is initially charged to a high charge potential, is discharged image wise in the background (white) image areas and to near zero or ground potential in the highlight (i.e. color other than black) color parts of the image.

At development station C, a magnetic brush development system, indicated generally by the reference numeral 30 advances developer materials into contact with the electrostatic latent images. The development system 30 comprises first and second developer units 32 and 34. Preferably, each magnetic brush developer units includes a pair of magnetic brush developer rollers mounted in a housing. Thus, developer unit 32 contains a pair of magnetic brush rollers 35, 36 with developer unit 34 containing a pair of magnetic brush rollers 37, 38. Each pair of rollers advances its respective developer material into contact with the latent image. Appropriate developer biasing is accomplished via first and second power supplies 41 and 43, respectively, electrically connected to respective developer units 32 and 34.

Color discrimination in the development of the electrostatic latent image is achieved by moving the latent image recorded on the photoconductive surface past two developer units 32 and 34 in a single pass with the magnetic brush rolls 35, 36, 37 and 38 electrically biased to voltages which are offset from the background voltage, the direction of offset depending on the polarity of toner in the housing. The first developer unit 32, in the direction of movement of belt 18 as indicated by arrow 19, develops the discharged image areas of the photoconductive surface. This developer unit contains, for example, red developer material 40 having triboelectric properties such that the red toner is driven to the discharged image areas of the latent image by the electrostatic field between the photoconductive surface and the electrically biased developer rolls, which are electrically connected to the first bias power supply 41. Conversely, the second developer unit 34, in the direction of movement of belt 18 as indicated by arrow 19, develops the highly charged image areas of the latent image. This developer unit contains black developer, for example, material 42 having a triboelectric charge such that the black toner is urged towards highly charged areas of the latent image by the electrostatic field existing between the photoconductive surface and the electrically biased developer rolls in the second developer unit which are connected to the second bias power supply 43. The developer material 42 typically includes toner particles 10 triboelectrically attracted to ferromagnetic carrier granules or beads 15. Further, the first and second developer units 32 and 34 have bead removal devices 44 and 46 disposed therein and augers 47 for mixing and charging the developer material. Because the composite image developed on the photoreceptor consists of both positive and negative toner, a negative pre-transfer corona generating device 56 is provided to condition the toner for effective transfer of a developed toner image to a substrate using positive corona discharge.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with the photoconductive surface of belt 18 in a timed sequence so that the toner powder image developed thereon contacts the advancing sheet of support material at transfer station D.

Transfer station D includes a corona generating device 60 which sprays ions of a suitable polarity onto the backside of sheet 58. This attracts substantially simultaneously the black and non-black portions of the toner powder image from the belt 18 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, binding, inverting and returning the sheet for duplexing and the like.

After the sheet of support material is separated from the photoconductive surface of belt 18, the residual toner particles carried by image and the non-image areas on the photoconductive surface are charged to a suitable polarity and level by a preclean charging device 72 to enable removal therefrom. These particles are removed at cleaning station F. The vacuum assisted, electrostatic, fur brush cleaner unit 70 is disposed at the cleaner station F. The cleaner unit has two fur brush rolls that rotate at relatively high speeds which creates mechanical forces that tend to sweep the residual toner particles into an air stream (provided by a vacuum source), and then into a waste container. Subsequent to cleaning, a discharge lamp or corona generating device (not shown) dissipates any residual electrostatic charge remaining prior to the charging thereof for the next successive imaging cycle.

It is believed that the foregoing description is sufficient for purposes of the present application to illustrate the general operation of an electrophotographic printing machine incorporating the development apparatus of the present invention therein.

A bead removal device according to the present invention may be located anywhere between the development nip, the area between the photoreceptor and the developer roll where the development occurs, and the transfer station. Two of such positions are within the developer housing downstream of the development nip and in a separate BRD housing located between the developer housing and the transfer station.

An embodiment of the present invention for application within the develop housing will now be further discussed with reference to FIG. 3 which shows the second developer unit 34. Developer rollers 37 and 38 of the developer unit 34 are substantially identical to one another so only developer roller 37 will be described.

Developer roller 37 advances, for example, the black developer material 42, including both toner and beads, so that the toner will develop the electrostatic latent image recorded on the photoconductive surface of belt 18. Developer roller 37 is electrically biased so that the highly charged image areas of the latent image attract toner thereto. Developer roller 37 includes a non-magnetic tubular member or sleeve 80 preferably made from aluminum. Sleeve 80 generally rotates in the direction of arrow 82. A magnet assembly 84 is mounted interiorly of sleeve 80 and spaced therefrom. Magnet assembly 84 is stationary and positioned to attract the developer material to the lower exterior circumferential surface of sleeve 80. In this way, as sleeve 80 rotates in the direction of arrow 82, beads are attracted to the exterior circumferential surface by the pick-up magnet 90. Thus, beads with toner triboelectrically attracted thereto are magnetically attracted to the sleeve 80 which rotates to mechanically transport developer material (beads and toner) into the development zone 92.

As the beads and remaining toner pass the development zone, the beads carry out pole or magnet 102 acts to strongly attract the beads to the sleeve 80. But, as the roller continues to rotate, the beads reach an area 104, where the gravitational force and the centrifugal forces generally overcome the magnetic attraction holding the beads to the roller. This area 104 is often referenced as the bead release zone or point. The bead release zone is further enhanced by the use of a shunt 106 which attenuates the generated magnetic field in the release zone. The magnetic units 84 within the sleeves 80 can be formed in a variety of manners including, by way of example, that disclosed in U.S. Pat. Nos. 4,517,719 and 4,640,808.

Figure 3:
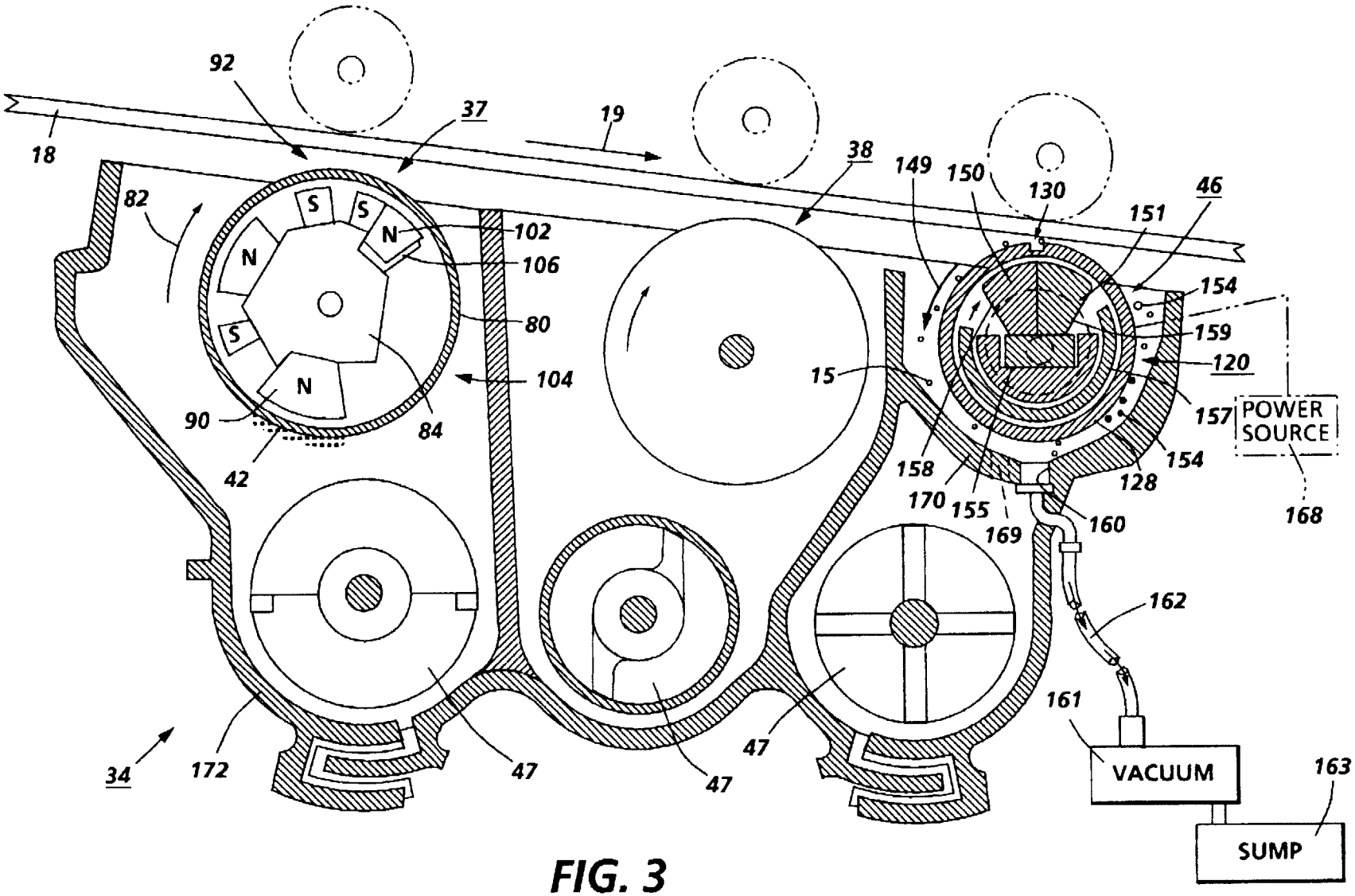
FIG. 3 is an elevational view, partially in section, of an embodiment of a developer unit of the FIG. 2 electrophotographic printing machine.

Continuing to reference FIG. 3, the second developer unit 34 is shown with a BRD (bead removal device) 46 having a sleeve 120. The sleeve 120 is formed of a hollow cylinder, such as a tube. The sleeve is made of a suitable durable material such as aluminum and fabricated by any suitable method such as extrusion. To maintain the thin wall thickness required for the sleeve 120, it may be necessary to machine outer periphery 128 of the sleeve 120. A spiral groove 130 is formed into the periphery 128 of the sleeve 120.

Figure 4A:
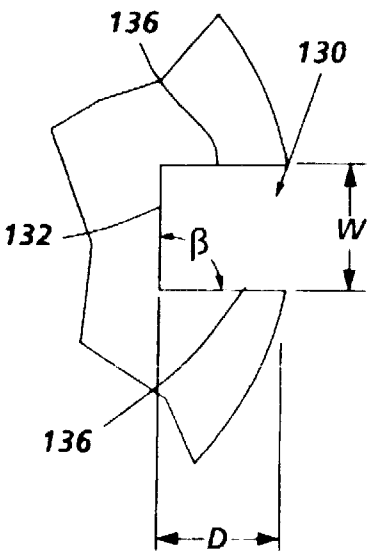
FIG. 4A is a partial elevational view of the FIG. 4 BRD sleeve showing the groove in greater detail.
Figure 4:
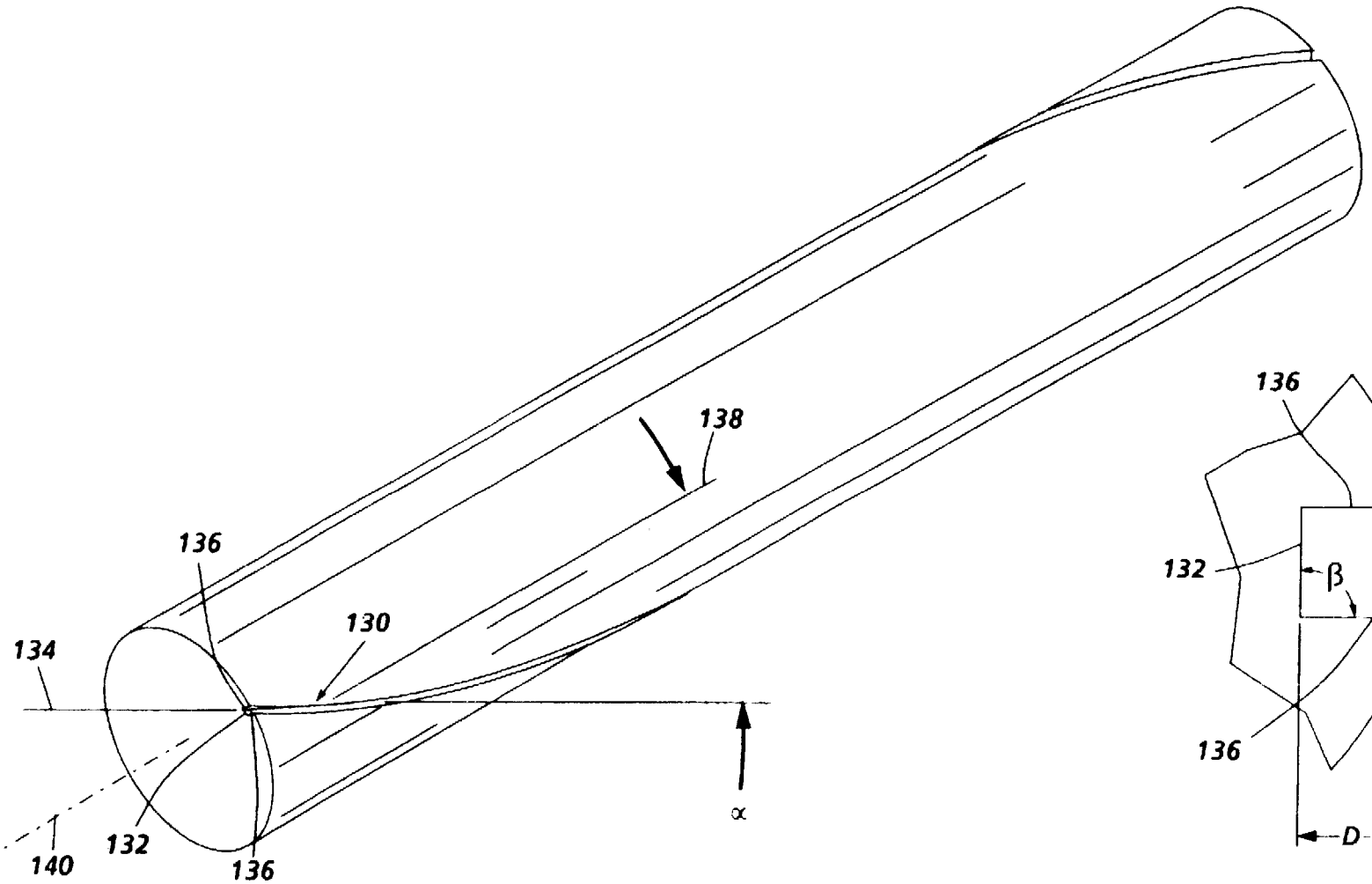
FIG. 4 is a perspective view of the BRD sleeve of the FIG. 3 developer unit.

Referring now to FIGS. 4 and 4A, the groove 130 is shown in greater detail. The groove 130 is defined by a bottom 132 which is preferably flat and perpendicular to centerline 134 of the groove. Extending from the bottom 132 of the groove 130 and the periphery 128 of the sleeve 120 are sides 136 which are preferably flat. Applicants have found that sides 136 which are approximately parallel to the centerline 134 are preferred. The sides form an angle β with the bottom 132 of preferably approximately 80°–100°. To effectively remove the carrier beads 15 with a diameter of 0.1 mm the sides 136 of the groove 130 have a depth D of approximately at least 0.2 mm and the bottom 132 of the groove 130 has a width W of approximately greater than 0.2 mm.

The groove 130 may have a spiral or helical portions as well as axially extending portions, but preferably has a spiral portion extending along substantially its entire length. The groove 130 forms an angle a with a line 138 which is parallel to a longitudinal centerline 140 of the sleeve 120. The applicants have found that for large values of α, for example above 40° the beads 15 tend to move axially and are not effectively removed. For values of a of greater than 15 and less than 40 the beads 15 move somewhat axially but mostly tangentially, providing efficient bead removal while reducing the accumulation of beads in one axial position of the periphery of the sleeve 120.

While the sleeve 120 of the BRD as shown in FIG. 4 includes only —1— groove 130 it should be appreciated that the invention may be practiced with a plurality of helical grooves.

Referring again to FIG. 3, it is preferred that the bead removal device 46 generally rotates in the direction indicate by arrows 149 (i.e., opposite the direction of the developer rollers 37 and 38).

Referring again to FIG. 4, applicants have found that the provision of the spiral groove 130 in the sleeve 120 eliminates substantially all smudging. Additionally, Applicants have found that the depth D of the sides 136 are also significant to the performance of the present invention. For example, in the BRD reduced to practice, for trapping beads of approximately 0.1 mm, the radius of the sleeve 120 as measured from the periphery 128 to the center of the sleeve 120 ranges between approximately 12 mm and 17 mm with 15 mm being preferred. The sides 136 range between approximately 0.45 mm and 0.70 mm high with 0.55 mm being preferred. The sides 136 are preferred to be substantially perpendicular to the bottom 132 of the groove 130 between which they extend.

Applicants believe that the sides 136 connecting the bottom 132 and the periphery 128 extend at an angle no greater than approximately 105° with respect to the bottom 132 at their intersection and no less than 75°. This is because obtuse angles encourage the "walking" phenomena previously discussed and acute angles will not capture beads as well as more open angles and may trap beads.

While, in most applications, the BRD 46 will perform sufficiently as previously described, it may become advantageous to supplement the BRD 46 with an air flow device to draw beads away from the belt 18 and toward the BRD 46. Further, while ferro-magnetic carrier beads 15 are attracted by magnetic fields, non-ferro-magnetic particles and contaminants (designated 154) are not so attracted. The air flow device serves to remove these items 154 from the belt 18. The BRD is located downstream of the developer rolls 37 and 38 which have formed the developed image on the photoreceptor belt 18. The BRD 46, when an air flow device is added, must be so designed to remove non-ferro-magnetic particles 154 while avoiding disturbing the toner forming the latent image. A vacuum pump 161 may be used to generate such an air flow.

For example, as shown in FIG. 3, a vacuum port 160, may be positioned in the wall of the housing of the development unit 34. The port 160 is connected to the vacuum pump 161 via a conduit 162 to urge release of carrier granules 15 retained on the sleeve 120. These materials may either be permitted to pass through an opening 169 (shown in phantom) in wall 170 onto auger 47 or to be deposited in a sump 163. If the materials are not permitted to pass through opening 169 in wall 170, a second port (not shown) is also positioned in the housing to allow materials not passing through the vacuum port 160 to sump 163 to pass to another sump through another conduit (not shown). It will be recognized that in many applications the sumps can be combined into a single sump so that materials passing through both ports ultimately end in the single sump and/or that both ports could be connected to the vacuum pump 161.

A vacuum pump may also be provided to assist release of beads and toner particles from the sleeve 120. The vacuum port 160 connected to the vacuum pump 161 via conduit 162 urges developer material from the sleeve 120 to sump 163. Alternately, the beads 15 may pass through a hole 169 (shown in phantom) in wall 170 into development housing 172.

Where the vacuum port 160 is employed, it is preferred that the ports are between 0.25 and 1.50 mm away from the sleeve 120 and sleeve 120 of the BRD 46 in FIG. 3, with 0.75 mm being preferred. Further, applicants have used a flow rate of approximately 30 liters/sec into a nozzle which is 2 mm wide and approximately 360 mm long. An appropriate flow rate is believed to be between 15 and 90 liters/sec into a nozzle between 0.75 and 4.00 mm wide. To avoid the air flow affecting the development of the image on the belt 18, the vacuum port is disposed adjacent the sleeve and the air passage around the sleeve adjacent the belt 18 is substantially open.

To assure proper air flow around the sleeve 120 the housing of the development unit 34 surrounding the sleeve 120 needs to closely conform to the sleeve to assist the proper flow of the air. It may be advantageous to position the sleeve eccentrically in the opening of the housing to provide for directional air flow.

The magnetic field generator of the BRD 46, however, comprises two magnets, magnets 150 and 151, disposed in a fixed relationship with the belt 18. The magnets 150 and 151 are stationary within the plural level sleeve 120. Shunt 155 is disposed within the sleeve 120 to shape the magnetic fields generated by the magnets 150 and 151 in selected directions. Further, shunt 157 is positioned in conjunction with the magnets 150 and 151 and shunt 155 so the magnetic field from the magnets is attenuated in all but those directions generally radiating toward the belt 18.

Shunts 155 and 157 of the bead removal device 46 are preferably formed of a ferromagnetic material (e.g., low carbon cold rolled steel with a thickness greater than 1 mm and preferably approximately 1.6 mm thick). The permeability of the material used is approximately 1000 gauss and preferably between 180 and 1000 gauss. The magnets 150 and 151 are of substantially opposite polarity relative to their positioning within the sleeve 120. The magnets are preferably a Neodymium Iron Boron alloy (NIB) available from Delco-Remy (a division of General Motors Corporation). It will be appreciated that other materials can be used to accomplish substantially the same results. The magnets and shunts may be held in place by foam.

As stated above, the magnets 150 and 151 are arranged in approximate opposite polarity orientation. That is, one magnet has a north pole of approximately opposite orientation of the north pole of the other so that the magnets 150 and 151 do not repel but rather attract each other. Applicants have found that the maximum force across the nip between the shell and the surface is yielded by magnetic vectors of the two magnets being offset between approximately 140° to 100° and preferably 120°. (See FIG. 3, wherein the north poles of magnet 150 and 151 are at 53° and 193°, respectively, so that in the example only 60° separate the opposite poles adjacent the belt 18.) Further, it has been found that magnetic fields radiating in directions away from the belt 18 in the shown configuration are minimized when walls 158 and 159 of magnets 150 and 151, respectively, are formed approximately parallel to the magnetic polar axis of the magnets 150 and 151, respectively.

In some cases, arc shunt 157 should extend in a direction further toward the photoconductive belt 18. It has been found that, due to the proximity of the developer rollers 37 and 38 to bead removal device 46 the magnetic fields between them can inhibit and affect their respective functions. This and the shaped walls 158 and 159 substantially eliminate magnetic interference or cross talk between the bead removal device and developer roller.

Additionally, in some instances, application of an AC or DC voltage to the sleeve 120 from an AC or DC power source 168 substantially increases the bead removal efficiency of the bead removal device 46. Applicants have found that the voltage applied should be between 1000 and 3000 volts peak to peak AC or 500 and 1500 volts DC and, preferably, approximately 1000 volts of a low amperage AC voltage or 1000 volts of a DC voltage.

Applicants have also discovered that in some instances application of an AC or DC voltage from an AC or DC power source 168 to the sleeve 120 of the bead removal device 46 increases the efficiency of such devices. Applicants have found that the voltage applied should be between 1000 and 3000 volts peak to peak AC or between 500 and 1500 volts DC and, preferably, approximately 2000 volts of a low amperage AC voltage or 1000 volts DC. Nevertheless, Applicants have also found that application of such a voltage to the BRD sleeve 120, which in this case is electrically isolated from housing 172 of the developer unit 34, is of limited value. In some applications, over time, the buildup of material including toner along the sleeve may foul it and minimize its effectiveness. Thus, Applicants have also found it may be appropriate to include a vacuum means as embodied in the port 160 and vacuum pump 161 to assist removal of developer material including beads from the housing.

Further, as will be appreciated, except for the portions of the sleeve proximate the photoconductive surface and the portions immediately adjacent thereto the magnetic field strength along the bead removal device's sleeve 120 is minimized by the disclosed arrangement. The optimal arrangement is dependent, in part, upon the characteristics of the developer material and ambient conditions. However, as indicated, the disclosed plural surface sleeve overcomes the problems associated with failure of prior arrangements to move substantially all beads to the bead release area.

Referring to FIG. 3, the structure and function of the present invention are illustrated in greater detail. The beads 15 are attracted to the bead pick off zone and then fall into trough areas where they are held to the sleeve as it rotates toward the release area and are inhibited from walking over the raised portions due to the depth of the trough and the relatively perpendicular nature of the radially extending portions.

Applicants have further found that overall performance of the BRD may be improved, if the captured beads are directed to a sump for removal rather than returned to the developer material in the developer housing 172 for reuse. It appears that recirculation of the beads captured by the BRD into the developer housing tend to be prone to carry out. Thus, in the preferred embodiment, the sump means as embodied in sump 163 is provided for the developer material captured by the BRD, including particularly beads. Nevertheless, satisfactory results have also been achieved with a recirculating system.

While the bead removal device 46 as shown in FIG. 3 may be in many cases sufficient for effective bead removal, in certain applications, involving very high speed belt movement, beads may still remain on belt 18 after the belt 18 passes by development unit 34. In such applications, in addition to BRD 46, an additional device is necessary to assure complete bead removal.

Figure 8:
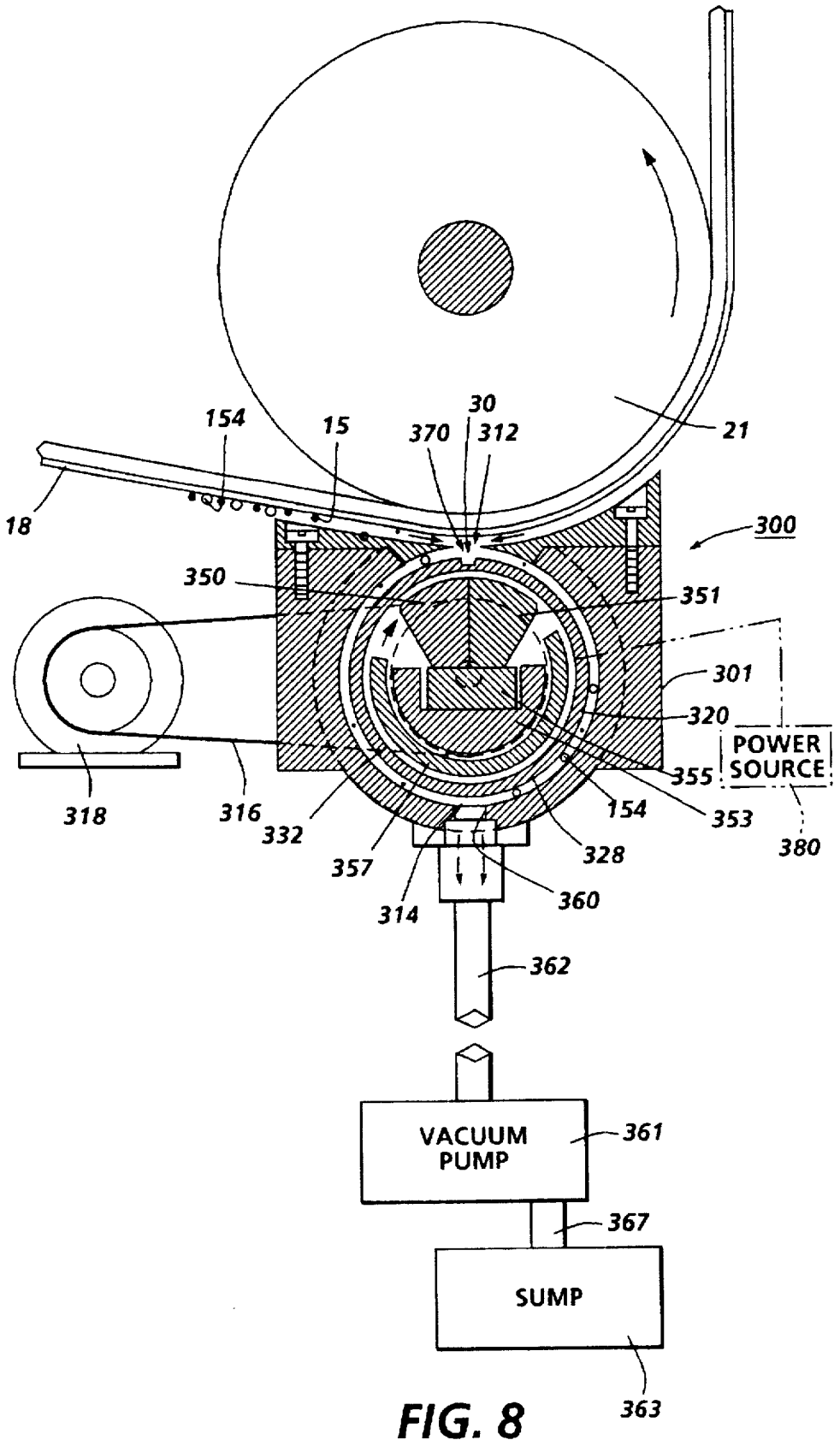
FIG. 8 is an elevational view, partially in section, of a bead removal device of another embodiment of the present invention.

Another embodiment of the present invention utilizing this additional device is shown in FIG. 8. This device has its own housing and is located between the developer housing and the transfer station. Specifically, referring to FIG. 2, a magnetic air bead pick off device 300 is shown positioned between a developer unit 34 and a transfer station D. It is believed that use of such a device improves efficient operation of an electrophotographic printing machine, including, particularly, by substantially reducing the number of beads carrying through to the transfer station and thus, substantially reduces bead deletions being visible in produced copies.

Again referring to FIG. 2, preferably the pick off device is positioned between the negative pre-transfer corona generating device 56 and the transfer station D. None the less the device 300 may also be effective between the developer unit 34 and the corona generating device 56. When positioned between the pre-transfer corona device 56 and the transfer station D, the charging of the developed image is critical. The charging is critical because the charging effects three critical portions of the xerographic process, cleaning, transfer and deletion, each with conflicting requirements. A high current charging of approximately 130 μA assist the transfer of the latent image at the transfer station D. An intermediate current charging of approximately 110 μA assist the cleaning of the belt 18 at the cleaning station F. A low current charging below 70 μA assist the deletion of beads and contaminants at the pick off device 300.

To control the critical developed image charging, preferably, the device 56 is a dicorotron with a glass coated wire 280 surrounded on three sides by a shield 282. A current control device 278 is attached to the device 56. The device 278 includes an alternating current power supply 284 which is electrically connected to the wire 280 and a direct current (DC) constant current source 286 which is electrically connected to the shield 282. The current control device 278 for the pre-transfer corona generating device 56 has been found to more accurately control charging current than the commonly used voltage control device. Therefore, the the pre-transfer corona generating device 56 is preferably utilizes the current control device 278. Applicants have found that by utilizing the current control device 278 and by setting the current at approximately 70 μA, the conflicting current charging needs of the cleaning station F, pick off device 300 and the transfer station D can be met, thereby permitting the placement of the bead removal device between the developer unit 34 and the transfer station D.

Again referring to FIG. 8, the magnetic air bead pick off device BRD 300 is shown with a housing 301 which has a rotating sleeve 320 mounted therein. The sleeve 320 is formed of a non-magnetic material, such as aluminum, and is preferred to be of a plural level structure somewhat similar to the sleeve 120 of FIG. 3. The sleeve 320 is formed of a hollow cylinder, such as a tube. The sleeve is made of a suitable durable material such as aluminum and fabricated by any suitable method such as extrusion. To maintain the thin wall thickness required for the sleeve 320, it may be necessary to machine outer periphery 328 of the sleeve 320. A spiral groove 330 is formed into the periphery 328 of the sleeve 320.

Figure 6:
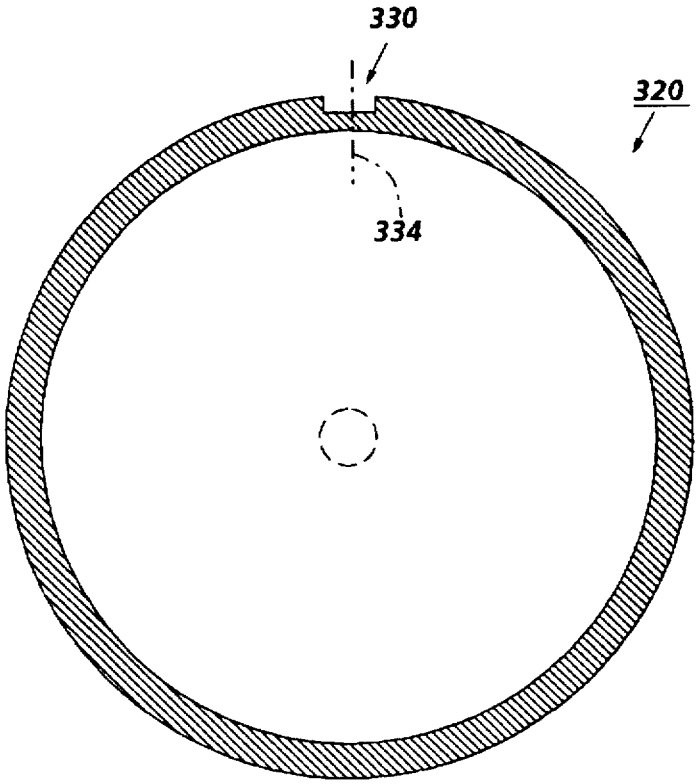
FIG. 6 is a sectional view along the line 5—5 in the direction of the arrows of the FIG. 5 BRD sleeve.
Figure 7:
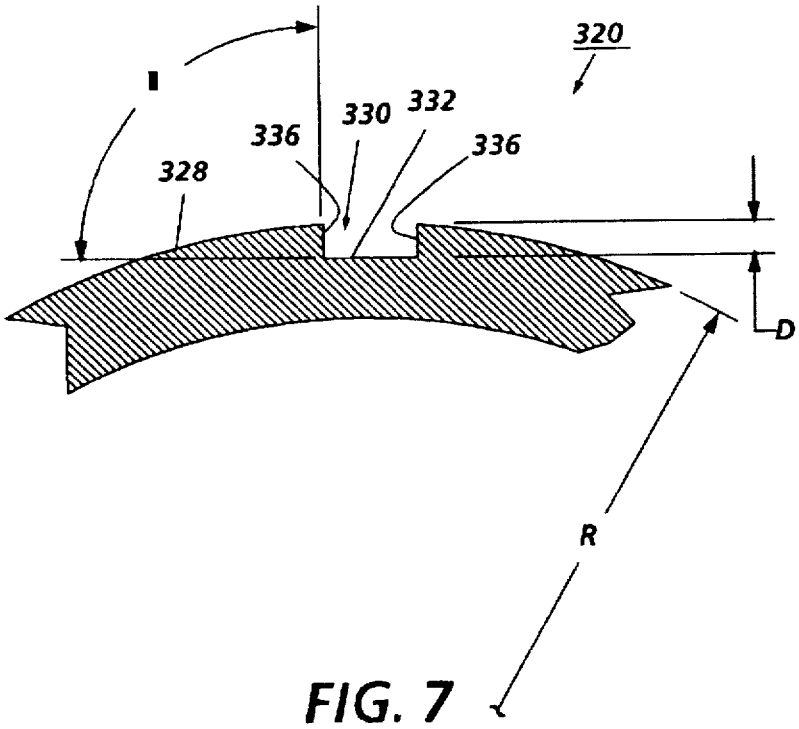
FIG. 7 is a partial sectional view of the FIG. 6 BRD sleeve showing the groove in greater detail.

Referring now to FIG. 6 and 7, the groove 330 is shown in greater detail. The groove 330 is defined by a bottom 332 which is preferably flat and perpendicular to the centerline 334 of the groove. Extending from the bottom 332 and the periphery 328 of the sleeve 320 are sides 336 which are preferably flat. Applicants have found that sides 336 which are approximately parallel to the centerline 334 are preferred. The sides form an angle β with the bottom 332 of preferably approximately 80°–100°. To effectively remove the carrier beads 15 with a diameter of 0.1 mm the sides 336 of the groove 330 have a depth D of approximately at least 0.2 mm and the bottom 332 of the groove 330 has a width W of approximately at least 0.2 mm.

Figure 5:
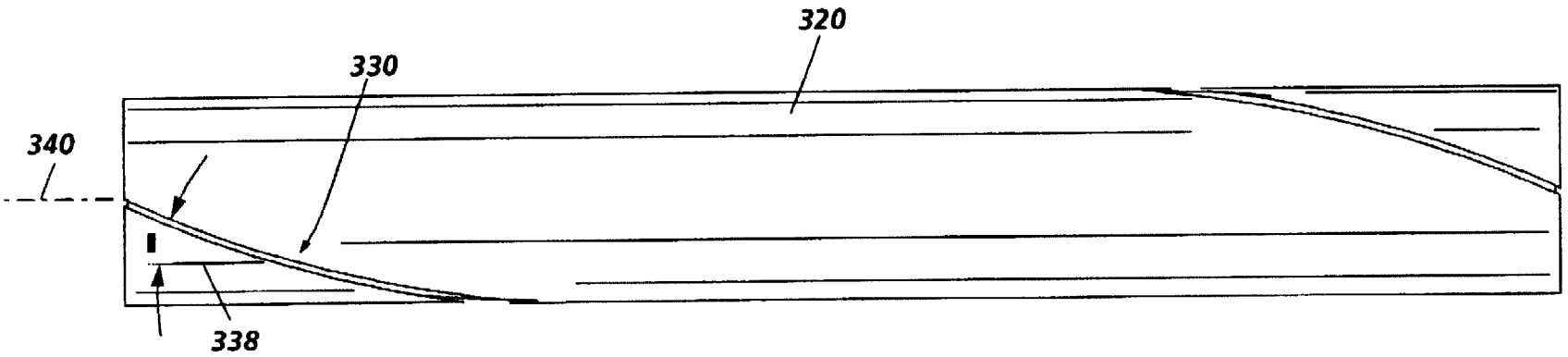
FIG. 5 is an elevational view of the BRD sleeve of the FIG. 1 bead removal device.

Referring now to FIG. 5, the groove 330 may have a spiral or helical portions as well as axially extending portions, but preferably has a spiral portion extending along substantially its entire length. The groove 330 forms an angle α with a line 338 which is parallel to a longitudinal centerline 340 of the sleeve 320. The applicants have found that for large values of α, for example above 40° the beads 15 tend to move axially and are not effectively removed. For values of α of greater than 35 and less than 40 the beads 15 move somewhat axially but mostly tangentially, providing efficient bead removal while reducing the accumulation of beads in one axial position of the periphery of the sleeve 320. While the sleeve 320 of the BRD as shown in FIG. 3 includes only —1— groove 330 it should be appreciated that the invention may be practiced with a plurality of helical grooves.

Referring again to FIG. 3, it is preferred that the bead removal device BRD 300 generally rotates in the direction indicate by arrows 349 (i.e., opposite the direction of the developer rollers 37 and 38).

Applicants have found that the provision of the spiral groove 330 in the sleeve 320 eliminates substantially all smudging. Referring again to FIG. 7, additionally, Applicants have found that the depth D of the sides 336 are also significant to the performance of the present invention. For example, in the BRD reduced to practice, for trapping beads of approximately 0.1 mm, the radius R of the sleeve 320 as measured from the periphery 328 to the center of the sleeve 320 ranges between approximately 32 mm and 37 mm with 35 mm being preferred. The sides 336 range between approximately 0.45 mm and 0.70 mm high with 0.55 mm being preferred. The sides 336 are preferred to be substantially perpendicular to the bottom 332 of the groove 330 between which they extend.

Applicants believe that the sides 336 connecting the bottom 332 and the periphery 328 extend at an angle β no greater than approximately 85° with respect to the bottom 332 at their intersection and no less than 75°. This is because obtuse angles encourage the "walking" phenomena previously discussed and acute angles will not capture beads as well as more open angles and may trap beads.

Referring again to FIG. 8, while, in most applications, the BRD 300 will perform sufficiently as previously described, it may become advantageous to supplement the BRD 300 with an air flow device to draw beads away from the belt 18 and toward the BRD 300. Further, while ferromagnetic carrier beads 15 are attracted by magnetic fields, non-ferromagnetic particles and contaminants (designated 154) are not so attracted. The air flow device serves to remove these items 154 from the belt 18. The BRD is located downstream of the developer rolls 37 and 38 which have formed the developed image on the photoreceptor belt 18. The BRD 300, when an air flow device is added, must be so designed to remove non-ferromagnetic particles 157 while avoiding disturbing the toner forming the latent image. A vacuum pump 361 may be used to generate such an air flow.

For example, as shown in FIG. 3, a vacuum port 360, may be positioned in the wall of the housing 301 of the BRD 300. The port 360 is connected to the vacuum pump 361 via a conduit 362 to urge release of materials 154 retained on the sleeve 320. These materials are permitted to pass to the sump 363 through conduit 367.

The sleeve 320 is driven by a any suitable means, such as a belt 316 and motor 318. Magnets 350 and 351 as well as shunts 353, 355 and 357 are fixedly mounted within the sleeve 320 which is mounted for rotation around them. The magnets 350 and 351 are positioned in the sleeve 320 so that a pick up zone 312 is defined on the shell of the sleeve 320 adjacent the surface of the belt 18. The positioning of the shunts and the magnets define a release area 314 where the magnetic field strength is generated by the magnets along the sleeve 320 is minimized or attenuated by the shunts.

The walls of the housing 301 form a venturi thin plate nozzle 370 adjacent the belt 18 opposite magnets 350 and 351 so that the air flow generated through the nozzle by the vacuum and the magnetic field generated by the magnet 320 attract materials both on and near the belt 18 toward the pickup zone. Thus, loose beads, free beads, and agglomerate materials are urged toward the inlet nozzle.

In employing the bead pick off device of this invention such as that disclosed in FIG. 8, it is preferred that the nozzle 370 should be spaced between 0.25 and 1.75 mm away from belt 18 with 0.75 mm being preferred. Preferably, the nozzle 370 should also be between 0.25 and 3.00 mm wide with a flow rate through the nozzle that is between 10 and 20 liters/sec. A nozzle 370 that is approximately 1 mm wide in the direction of belt rotation and 360 mm long with an air flow through the nozzle of 14 liters/sec. has been employed. Variations in these preferred parameters can be made according to the details and conditions of the printing machines and material in which the device is used as well as the ambient conditions. It will be further understood that the described embodiment of FIG. 8 may be placed, as appropriate, along the photoconductive surface between a developer unit and a transfer station.

It will be now recognized that in certain applications, the applying of an AC or DC bias to the sleeve 320 by an AC or DC power source 380 may enhance the performance of the device 300, as previously discussed with respect to the bead removal devices 46 of FIG. 3.

Figure 1:
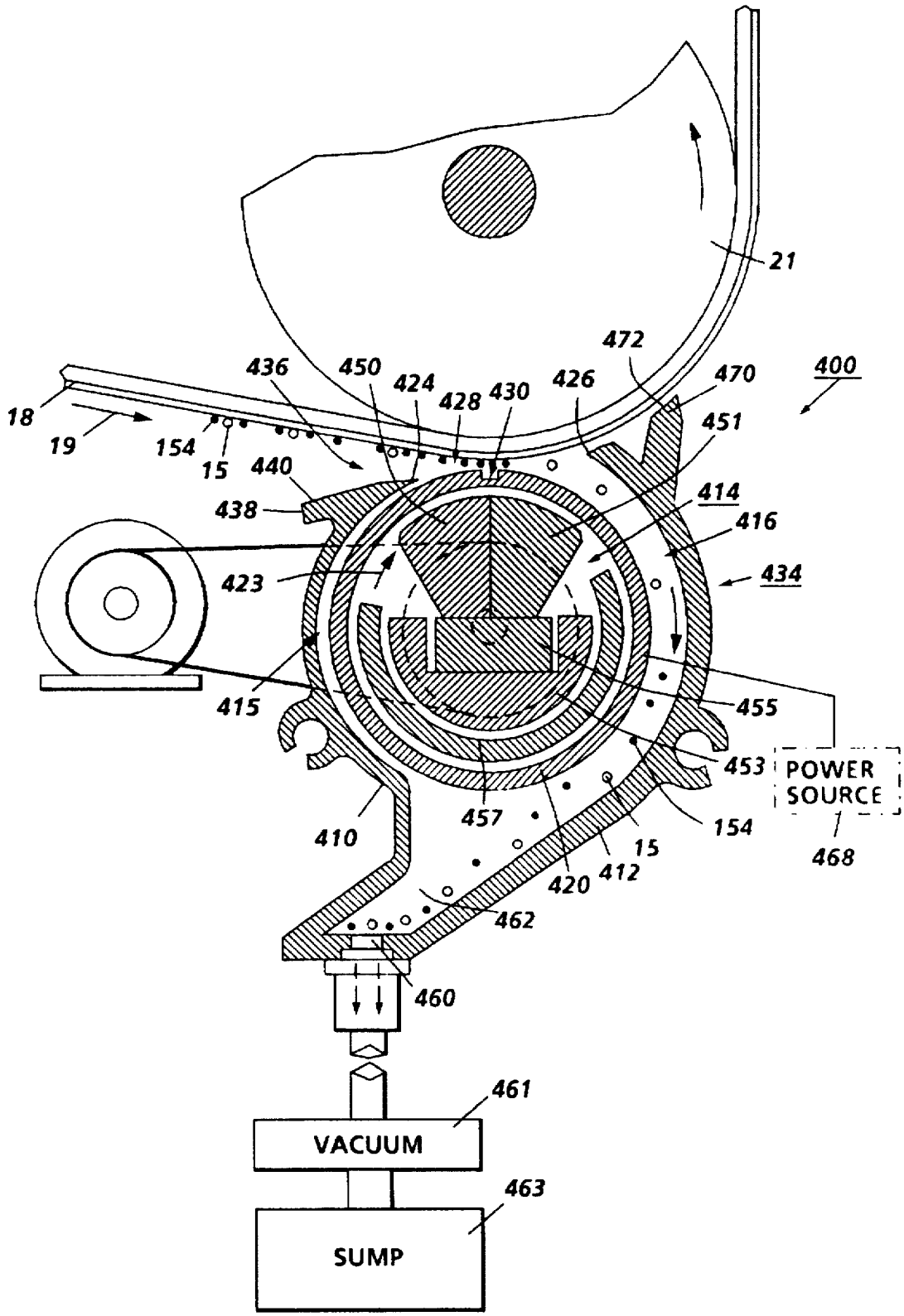
FIG. 1 is an elevational view, partially in section, of a bead removal device of an embodiment of the present invention.

A further embodiment of an alternate bead removal device 400 of the present invention is shown in FIG. 1. While the embodiments illustrated in FIGS. 3 and 8 may result in effective bead removal, the applicant has found that the embodiment utilizing the device 400 as illustrated in FIG. 1 is particularly effective in obtaining proper bead removal where particularly high belt speeds are encountered. The magnetic air bead pick off device 400 is positioned between the developer unit 34 and the transfer station D in a position similar to than of BRD 300 of FIG. 2. Preferably, to take advantage of the inertial effects of the beads and to closely control the spacing of the belt 18 to housing 434 by providing belt stability, the bead removal device 300 is preferably located adjacent an area of the belt 18 where the belt 18 turns. Such a position is adjacent the drive roller 21.

Now, referring to FIG. 1, the bead removal device 400 includes the housing assembly 434. The housing assembly 434 generally conforms to the contour of the belt 18 as it is in contact with the drive roller 21. The housing 434 preferably includes a left housing portion 410 located on the upstream side of the belt 18 and a right housing portion 412 located on the downstream side of the belt 18.

A bead removal sleeve 420 is located within the housing 434. The sleeve 420 is similar to sleeve 320 as shown in FIG. 8. Preferably the sleeve 420 rotates in the direction of arrow 423 which is the same direction as the direction of belt 18 as shown by arrow 19. The sleeve 420 includes groove 430 located about the periphery of the sleeve 420. The groove 430 is similar to the groove 330 as illustrated in FIGS. 5–7.

The bead removal device 300 of FIG. 1 includes a magnetic field generator 414 which is similar to the configuration as shown in FIG. 3. The magnetic field generator 414, includes left and right magnets 450 and 451, respectively, which are similar to magnets 150 and 151, as shown in FIG. 8. The field generator 414 also includes shunts 455 and 457 which are similar to the shunts 155 and 157, respectively, of FIG. 3. The magnetic field generator 414 further includes an arcuate shunt 453 which is located between shunt 455 and shunt 457. The shunt 453 serves to further improve the operation of the bead removal device 400 by assisting in the release of the beads.

Unlike the bead removal device 300 as shown in FIG. 8, the sleeve 420 is not centrally located within the housing 434. In fact, the sleeve 420 is significantly biased toward the left housing portion 410. This eccentric configuration is of great assistance in the effectiveness of this device to remove beads as will be later discussed. This configuration provides for a left air channel 415 located between the sleeve 420 and the left housing portion 410 which is significantly narrower than a right air channel 416 located between the sleeve 420 and the right housing portion 412.

To assist in the bead removal process, an air flow generator is preferably incorporated into the device to provide an air flow to blow beads from the belt 18. To provide this flow, the bead removal device 400 also includes a vacuum pump 461 which is connected to a sump 463. The vacuum pump 461 and the sump 463 are similar to the vacuum pump 361 and sump 363 as shown in FIG. 8. The vacuum pump 461 is connected to the right air channel 416 by means of a conduit 462. The conduit 462 connects the left air channel 415 and the right channel 416 at a vacuum port 460 located within the housing 434 opposite the photoreceptor belt 18.

Since the left air channel 415 forms a left air channel gap which is significantly smaller than a right air channel gap of the right air channel 416, air flow created by the vacuum pump 461 flows primarily through the right air channel 416. The left housing portion 410 has a left housing edge 424 adjacent the photoreceptor belt 18 and the right housing portion 412 has a right housing edge 426 adjacent the photoreceptor belt 18. The left housing edge 424 and the right housing edge 426 define an aperture 428 which is located in a nip area 436 between the photoreceptor belt 18 and the sleeve 420.

The left housing portion 410 includes a lip 438 which extends from the left housing edge 424 downwardly and toward the left away from the nip area 436 and away from the belt 18. The lip 438 includes an outer face 440 adjacent the photoreceptor belt 18. The face 440 is inclined downwardly away from the nip area 436 at an angle to the photoreceptor belt 18. The face 440, thus, defines an entry slope angle between the face 440 and the photoreceptor belt 18. While any of a variety of entry slope angles may be satisfactory for the practice of this invention, preferably the entry slope angle is approximately 15 degrees. The face 440 and the belt 18 form an air guide for directing the air flow into the nip area 436. The edge 424 and the photoreceptor belt 18 define a lip entry gap which size is influential in the proper flow of air through the bead removal device 400. Preferably, the lip entry gap is approximately between 0.8 mm and 1.5 mm. The space between the right housing edge 426 and the belt 18 defines an exit lip gap. The thickness of the exit lip gap influences the proper air flow through the bead removal device 300 and the applicants have found that the exit lip gap is preferably approximately 0.5 mm.

To isolate the air flow in the bead removal device 400 from the operation of other components within the machine, it may be desirable to include an air turbulence shield 470. The shield 470 avoids turbulence of paper within the machine paper path 59 (see FIG. 2). The air turbulence shield 470 may be positioned wherever suitable, but, preferably extends from the right housing portion 412 and has an outer face 472 conforming to and spaced from the photoreceptor belt 18. The face 472 and the belt 18 define a paper guide gap which the applicants have found to preferably be approximately 0.63 mm.

The eccentric mounting of the sleeve 420 within the housing 434 provides for an air flow which significantly improves bead and particle removal. Air flow enters at the air guide and is concentrated at the nip 436 where the air blows most beads and particles that have not been removed by magnets 450 and 451 or by AC/DC bias from the belt 18. The air continues to flow generally into right air channel 416 in a direction co-linear to the belt 18 as it enters the nip area 436. The inertia of the beads 15 and particles 154 urging them to continue to travel in a direction parallel to the belt as it enters the nip area and the co linear air flow work in harmony to separate the beads 15 and particles 154 from the belt 18. The position of the bead removal device 400 below the belt allows gravity to further assist the beads and particles.

In order to optimize the performance of the bead removal device 400, preferably, the photoreceptor belt 18 is movable relative to the sleeve 420. Applicants have found that the belt to sleeve spacing is critical for the performance of the bead removal device 300. A belt to sleeve spacing of approximately 0.63 mm has been found to be optimal for the performance of the device 300. Manufacturing tolerances and idiosyncrasies in the operation of the bead removal device 400 may render a fixed belt 18 and sleeve 420 arrangement not conducive for obtaining an optimum belt to sleeve spacing. During assembly of the bead removal device 400, adjustments in the spacing between the belt 18 and sleeve 420 may be made to obtain optimum performance. Further, during servicing of the device 400, movement of the belt 18 to the sleeve 420 may be useful to test the operation of the bead removal device 400.

Air drawn by the vacuum pump 461 enters the bead removal device 400 at the lip entry gap being directed by the air guide. Beads 15 and particles 154 adhering to the belt 18 are drawn from the belt 18 by the combination of the magnetic field generated by magnets 450 and 451 and air flow passing by the nip area 436. The beads and particles continue through the right air channel 416 and out the vacuum port 460. From there the beads and particles progress down the conduit 462, into the vacuum pump 461 and into the sump 463.

It will be now recognized that in certain applications, the applying of an AC or DC bias to the sleeve 420 by an AC or DC power source 468 may enhance the performance of the device 400, as previously discussed with respect to the bead removal device 300 of FIG. 8.

It will be understood that the spiral grooved magnetic bead pick off devices of this invention, as described in illustrative detail in conjunction with FIGS. 1–8, can be used singularly or in conjunction with the other embodiments of this invention effectively, as well as with other devices, as necessitated by the constraints of the applications in which employed. The present invention, as previously indicated is not limited to use in single-pass highlight color electrophotographic printing machines but would be useful in single, two-pass and multi-pass electrographic printing machines generally. Applicants have found satisfactory results with the employment of two embodiments of the invention concurrently (e.g., a spiral grooved magnetic bead pick off device in the developer housing itself and another spiral grooved bead pick off device position downstream therefrom prior to the transfer station.). But in many circumstances, as indicated, employment of a single embodiment of the present invention achieves the aims and goals of this application.

The bead removal device is effective for both the ferromagnetic and non ferro-magnetic particles as well as for contaminants. The BRD combines a directed air flow steam and magnetics to remove the beads and particles from the belt. Electrostatics can also be used to remove the beads and particles from the belt. The spiral grooved surface can assist in the transport the removed beads and particles through the bead removal device.

The single spiral groove in the sleeve creates less distortion in the sleeve and results in a rounder sleeve when machined than a plurality of equally spaced axial grooves of prior art BRDs.

The single spiral grooved sleeve is mechanically stronger that a sleeve with a prior art BRD plurality of equally spaced axial grooves.

Unlike prior art BRDs where the beads congregate at a portion of the photoreceptor quickly fill the axial grooves of the BRD, the congregated beads are distributed axially by the spiral groove distributing the beads along the length of the sleeve and improving the efficiency of the BRD.

The use of a spiral groove assures that beads will be constantly removed from the photoreceptor as at least a portion of the groove is constantly in the position of the nip between the photoreceptor and the BRD sleeve.

It is, therefore, apparent that there has been provided in accordance with the present invention, a BRD for use in an electrophotographic printing machine that fully satisfies the aims and advantages hereinbefore setforth. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for removing magnetic granules from a moving imaging surface in a region between a developer station and a transfer station, comprising:

a removing member rotatable about a longitudinal axis, interposed between the developer station and the transfer station, defining a groove in an exterior surface thereof having at least a portion of the groove extending in a direction skewed to the longitudinal axis of said removing member, the groove having dimensions and a skewed direction relative to a periphery of the member selected to provide for moving most of the magnetic granules tangentially about the periphery of the member and selected to provide for reducing an accumulation of beads in one axial position on the periphery of the member; and a magnetic member, operatively associated with said removing member, for generating a magnetic field to attract the magnetic granules from the imaging surface to said removing member, at least a portion of said removing member rotatable about at least a portion of said magnetic member, wherein most of the magnetic granules are propelled tangentially about the periphery of the member and wherein the accumulation of beads in one axial position on the periphery of the member may be somewhat reduced.

2. The apparatus of claim 1, wherein said removing member extends in a direction substantially transverse to the movement of the imaging surface.

3. The apparatus of claim 1, further comprising:

a housing defining a chamber and an aperture proximate the moving imaging surface, said removing member being mounted in the chamber of said housing; and an air flow generator, coupled to said housing, for generating an air flow through the chamber of said housing so that the granules are attracted toward the aperture.

4. The apparatus of claim 1, wherein said removing member comprises spaced, opposed side walls defining the groove, said side walls extending inwardly from the exterior surface at an angle ranging between approximately 75° and 105°.

5. The apparatus of claim 1, wherein:

said removing member comprises a rotatably mounted sleeve; and said magnetic member comprises an elongated magnet disposed interiorly of said sleeve.

6. The apparatus of claim 1, wherein the groove forms a spiral in the exterior surface of the removing member.

7. The apparatus of claim 1:

wherein said removing member defines a length and the periphery thereof;

wherein the groove extends substantially the length of said removing member; and wherein the groove extends at least once around the periphery of the removing member.

8. The apparatus of claim 1, wherein the groove has a depth of at least approximately 0.05 mm.

9. The apparatus of claim 1, wherein the groove has a width of less than approximately 4.0 mm.

10. The apparatus of claim 1, wherein the groove intersects a line parallel to the longitudinal axis of said removing member at an angle of less than approximately 30 degrees.

11. A developer unit for developing a latent image recorded on a moving image receiving member at a developer station to form a developed image for later transfer to a surface at a transfer station, comprising:

a housing defining a chamber for storing a supply of magnetic granules and marking particles therein;

a moving donor member spaced from the image receiving member for transporting marking particles from the chamber of said housing to a development zone adjacent the image receiving member; and an apparatus for removing the magnetic granules from the image receiving member in a region between said donor member and a transfer station, the apparatus including a removing member rotatable about a longitudinal axis, interposed between the developer station and the transfer station, defining a groove in an exterior surface thereof having at least a portion of the groove extending in a direction skewed to the longitudinal axis of said removing member and a magnetic member, operatively associated with said removing member, for generating a magnetic field to attract the magnetic granules from the image receiving member to said removing member, at least a portion of said removing member rotatable about at least a portion of said magnetic member the groove having dimensions and a skewed direction relative to a periphery of the removing member selected to provide for moving most of the magnetic granules tangentially about the periphery of the removing member and selected to provide for reducing an accumulation of beads in one axial position on the periphery of the removing member, wherein most of the magnetic granules are propelled tangentially about the periphery of the removing member and wherein the accumulation of beads in one axial position on the periphery of the removing member may be somewhat reduced.

12. The developer unit of claim 11, wherein said removing member extends in a direction substantially transverse to the movement of said image receiving member.

13. The developer unit of claim 11, wherein said housing defines an aperture proximate the image receiving member and further comprising an air flow generator, coupled to said housing, for generating an air flow through the chamber of said housing so that the granules are attracted toward the aperture.

14. The developer unit of claim 11, wherein said removing member comprises spaced, opposed side walls defining the groove, said side walls extending inwardly from the exterior surface at an angle ranging between approximately 75° and 105°.

15. The developer unit of claim 11, wherein:

said removing member comprises a rotatably mounted sleeve; and said magnetic member comprises an elongated magnet disposed interiorly of said sleeve.

16. The developer unit of claim 11, wherein the groove forms a spiral in the exterior surface of the removing member.

17. The developer unit of claim 16:

wherein said removing member defines a length and the periphery thereof;

wherein the groove extends substantially the length of said removing member; and wherein the groove extends at least once around the periphery of the removing member.

18. The developer unit of claim 11, wherein the groove has a depth of at least approximately 0.05 mm.

19. The developer unit of claim 11, wherein the groove has a width of less than approximately 4.0 mm.

20. The developer unit of claim 11, wherein the groove intersects a line parallel to the longitudinal axis of said removing member at an angle of less than approximately 30 degrees.

21. An electrophotographic printing machine having a developer unit for developing with marking particles a latent image recorded on a moving image receiving member at a developer station for later transfer to a surface at a transfer station, the machine comprising:

a housing defining a chamber for storing a supply of magnetic granules and marking particles therein;

a moving donor member spaced from the image receiving member and for transporting the marking particles from the chamber of said housing to a development zone adjacent the image receiving member; and an apparatus for removing the magnetic granules from the image receiving member in a region between said donor member and a transfer station, the apparatus including a removing member rotatable about a longitudinal axis, interposed between the developer station and the transfer station, defining a groove in an exterior surface thereof having at least a portion of the groove extending in a direction skewed to the longitudinal axis of said removing member and a magnetic member, operatively associated with said removing member, for generating a magnetic field to attract the magnetic granules from the image receiving member to said removing member, at least a portion of said removing member rotatable about at least a portion of said magnetic member the groove having dimensions and a skewed direction relative to a periphery of the removing member selected to provide for moving most of the magnetic granules tangentially about the periphery of the removing member and selected to provide for reducing an accumulation of beads in one axial position on the periphery of the removing member, wherein most of the magnetic granules are propelled tangentially about the periphery of the removing member and wherein the accumulation of beads in one axial position on the periphery of the removing member may be somewhat reduced.

22. The printing machine of claim 21, wherein said removing member extends in a direction substantially transverse to the movement of said image receiving member.

23. The printing machine of claim 21, wherein said housing defines an aperture proximate the image receiving member and further comprising an air flow generator, coupled to said housing, for generating an air flow through the chamber of said housing so that the granules are attracted toward the aperture.

24. The printing machine of claim 21, wherein said removing member comprises spaced, opposed side walls defining the groove, said side walls extending inwardly from the exterior surface at an angle ranging between approximately 75° and 205°.

25. The printing machine of claim 21, wherein:

said removing member comprises a rotatably mounted first sleeve; and said magnetic member comprises an elongated first magnet disposed interiorly of said sleeve.

26. The printing machine of claim 21, wherein the groove forms a spiral in the exterior surface of the removing member.

27. The printing machine of claim 26:

wherein said removing member defines a length and the periphery thereof;

wherein the groove extends substantially the length of said removing member and wherein the groove extends at least once around the periphery of the removing member.

28. The printing machine of claim 21, wherein the groove has a depth of at least approximately 0.05 mm.

29. The printing machine of claim 21, wherein the groove has a width of less than approximately 4.0 mm.

30. The printing machine of claim 21, wherein the groove intersects a line parallel to the longitudinal axis of said removing member at an angle of less than approximately 30 degrees.

31. The printing machine of claim 21, wherein said apparatus is disposed at least partially within said housing.

32. The printing machine of claim 21, wherein said apparatus is disposed external to said housing and interposed between the developer unit and the transfer station.

* * * * *